US009446930B2

(12) United States Patent
Lee

(10) Patent No.: US 9,446,930 B2
(45) Date of Patent: Sep. 20, 2016

(54) EMERGENCY STOP DEVICE WITH ATTACHED HAND BRAKE SYSTEM

(75) Inventor: Gum Gee Lee, Seoul (KR)

(73) Assignee: Gumyoung General Co., Ltd., Seoul (KR)

( * ) Notice: Subject to any disclaimer, the term of this patent is extended or adjusted under 35 U.S.C. 154(b) by 327 days.

(21) Appl. No.: 14/235,299

(22) PCT Filed: Jul. 3, 2012

(86) PCT No.: PCT/KR2012/005264

§ 371 (c)(1),
(2), (4) Date: Jan. 27, 2014

(87) PCT Pub. No.: WO2013/024969

PCT Pub. Date: Feb. 21, 2013

(65) Prior Publication Data

US 2014/0158471 A1 Jun. 12, 2014

(30) Foreign Application Priority Data

Aug. 12, 2011 (KR) ..... 10-2011-0080679

(51) Int. Cl.
*B66B 5/22* (2006.01)
*B66B 5/16* (2006.01)

(52) U.S. Cl.
CPC .. *B66B 5/22* (2013.01); *B66B 5/16* (2013.01)

(58) Field of Classification Search
CPC ..... B66B 5/16; B66B 5/22
See application file for complete search history.

(56) References Cited

U.S. PATENT DOCUMENTS 1,360,653 A * 11/1920 Liddicoat ..... B66B 5/22 187/372
2,150,373 A * 3/1939 Hymans ..... B66B 5/22 187/376
2,897,920 A * 8/1959 Falter ..... B66B 5/22 187/372
5,301,773 A * 4/1994 Jamieson ..... B66B 5/22 187/376
6,003,636 A * 12/1999 Yumura ..... B66B 5/22 187/376

* cited by examiner

*Primary Examiner* — William E Dondero
*Assistant Examiner* — Diem Tran
(74) *Attorney, Agent, or Firm* — DeLio, Peterson & Curcio LLC; Peter W. Peterson

(57) ABSTRACT

Disclosed is an emergency stop device with an attached hand brake system. The emergency stop device with the attached hand brake system comprises: brake units which are equipped on both sides of a car and control the movements of the car by selectively interfering with guide rails; an operation unit which is connected with the brake units and manually grants braking power to the braking units; and an interlocking unit which interlocks the brake units.

3 Claims, 9 Drawing Sheets

EMERGENCY STOP DEVICE WITH ATTACHED HAND BRAKE SYSTEM

BACKGROUND OF THE INVENTION

1. Field of the Invention

The present invention relates to an emergency stop device with a hand brake system attached thereto, and more particularly, to an emergency stop device with a hand brake system attached thereto which enables easy installation of a guide rail in a state where a governor cannot be connected when installing an elevator and may prevent a safety accident by falling.

2. Description of Related Art

In general, an elevator installed in a building is provided with an emergency stop device which urgently stops a car in a crisis situation for the safety of passengers or goods. An elevator accident caused when a main rope connected to the top end of the car is cut is not easy to anticipate in view of the mechanical design of the elevator. Rather, an accident caused by an abnormal operation of a winding machine of the elevator may be anticipated. Of course, even when the main rope is cut, the emergency stop device is operated. Typically, an emergency stop device of an elevator is adapted to be operated using a governor. Such an emergency stop device is classified into a momentary stop type which suddenly stops the car as soon as receiving a signal from the governor and a gradual stop type which allows the car to slip to a certain degree upon receiving the signal from the governor.

Korean Utility Model Laid-Open Publication No. 20-2010-0000908 (published on Jan. 27, 2010) discloses "Emergency stop device of Elevator".

FIG. 1 is a perspective view illustrating a schematic construction of an elevator in which the gradual stop type is employed.

A body framework 4 is installed around a car 2. The body framework 4 includes a top frame 4*a*, side frames 4*b*, and a bottom frame 4*c*. A guide rail 6 with a substantially T-shaped cross-section is installed on each side wall of the elevation passage via brackets 14. The car 2 is moved up or down along the guide rails 6 by being pulled up or released by a main rope 8 extending from a sheave (not illustrated). When the car 2 is moved down at a speed higher than a regulated speed, a governor rope is stopped by the governor so that a speed difference occurs between the car 2 and the governor, thereby driving an emergency stop device 12. When gaps between the emergency stop device 12 and the guide rails 6 are clamped in a wedge manner, the car 2 is physically prevented from being moved downward along the guide rails 6. However, when an elevator installation of installing the guide rails 6 upward from the bottom side to the top side is applied, the governor and the governor rope are not provided. Thus, the car 2 is suspended from a winch to be moved up and down while working. As a result, when the winch or a chain block is broken, it may be directly led to an accident because no emergency stop device is provided.

The above-described technical construction is provided as a background so as to help the understanding of the present invention. However, the construction is not well-known in the art to which the present invention belongs.

SUMMARY OF THE INVENTION

Technical Problem

The present invention has been made in an effort to solve the problems as described above, and an object of the present invention is to provide an emergency stop device with a hand brake system attached thereto which may stably stop a car by a worker's intention in a state where a governor and a governor rope cannot be provided, thereby improving a working environment when installing an elevator as well as preventing an accident from happening.

Technical Solution

An emergency stop device with a hand brake system according to the present invention includes: brake units which are provided on both sides of a car and selectively interfered with guide rails so as to restrain the movement of the car; an operation unit connected with the brake units to manually provide a braking force to the braking units; and an interlocking unit which causes the brake unit provided on both sides of the car to be interlocked by the operation of the operation unit.

The brake units include: accommodation blocks that form restraint slots configured to accommodate the guide rails, respectively, each of the slots being narrowed toward an upper side; and friction blocks that are provided in the accommodation blocks, the friction blocks being configured to be moved in the restraint slots by operating the operation unit to be interfered with the guide rails.

The operation unit includes: rotation brackets which are rotatably provided in the car, one end of each of the rotation brackets being connected with one of the friction blocks so that, when the rotation brackets are rotated, the friction blocks are interfered with the guide rails; and a lever unit configured to rotate the rotation brackets.

The lever unit includes: an operation piece hinged to the car; an operation lever provided on the operation piece to rotate the operation piece; and a link member eccentrically connected to the operation piece to transmit the rotation of the operation piece to the rotation brackets.

The lever unit includes a braking maintaining unit provided on the operation piece to maintain the braking state of the car.

The braking maintaining unit includes a weight eccentrically connected to the operation piece.

The braking maintaining unit includes an elastic member one side of which is eccentrically connected to the operation piece and the other side is connected to the car.

The interlocking unit includes: connection pieces which are eccentrically provided on the rotation brackets, respectively, and point-symmetrical to each other; and a connection bar that interconnects the connection pieces.

Advantageous Effects

The emergency stop device with a hand brake system according to the present invention may stably stop a car according to a worker's intention in a state where a governor and a governor rope cannot be provided. Therefore, a working environment at the time of installing an elevator may be improved and a safety accident may be prevented from happening.

In addition, the operation lever is moved in an emergency stopping direction by the braking maintaining unit configured by a weight. Therefore, a potential error may be prevented from happening and the operation lever may be easily operated.

DESCRIPTION OF THE PREFERRED EMBODIMENT(S)

Figure 1:
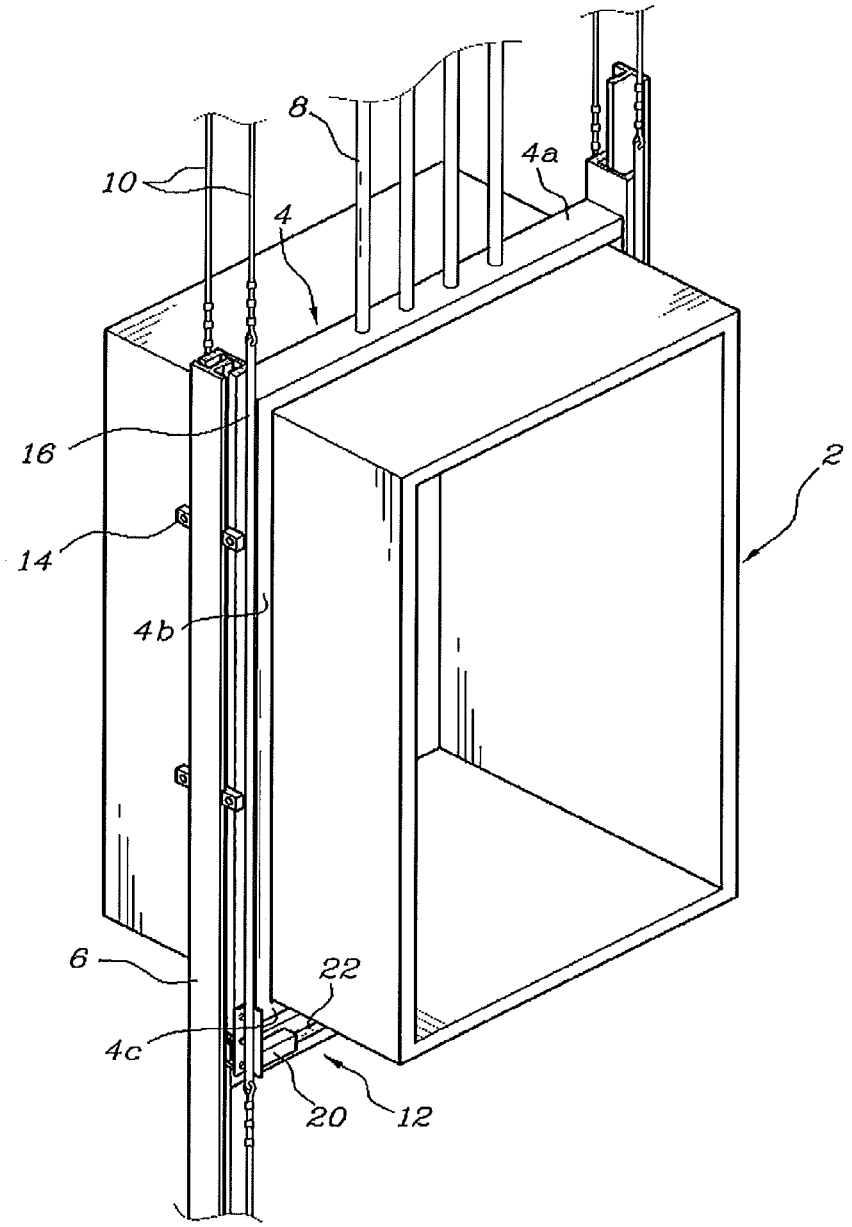
FIG. 1 is a perspective view illustrating a schematic configuration of an elevator in which a gradual stop type is employed.

Hereinafter, an emergency stop device with a hand brake system attached thereto according to an exemplary embodiment of the present invention will be described with reference to accompanying drawings. Thickness of lines, sizes of constituent elements illustrated in the drawings may be exaggerated for the purpose of clarity and convenience of description. In addition, the terms used herein are those defined in consideration of functions in the present invention and may be different from those used according to an intention of a user or an operator or a practice. Thus, the definitions of the terms shall be determined based on the contents described throughout the specification.

Figure 2:
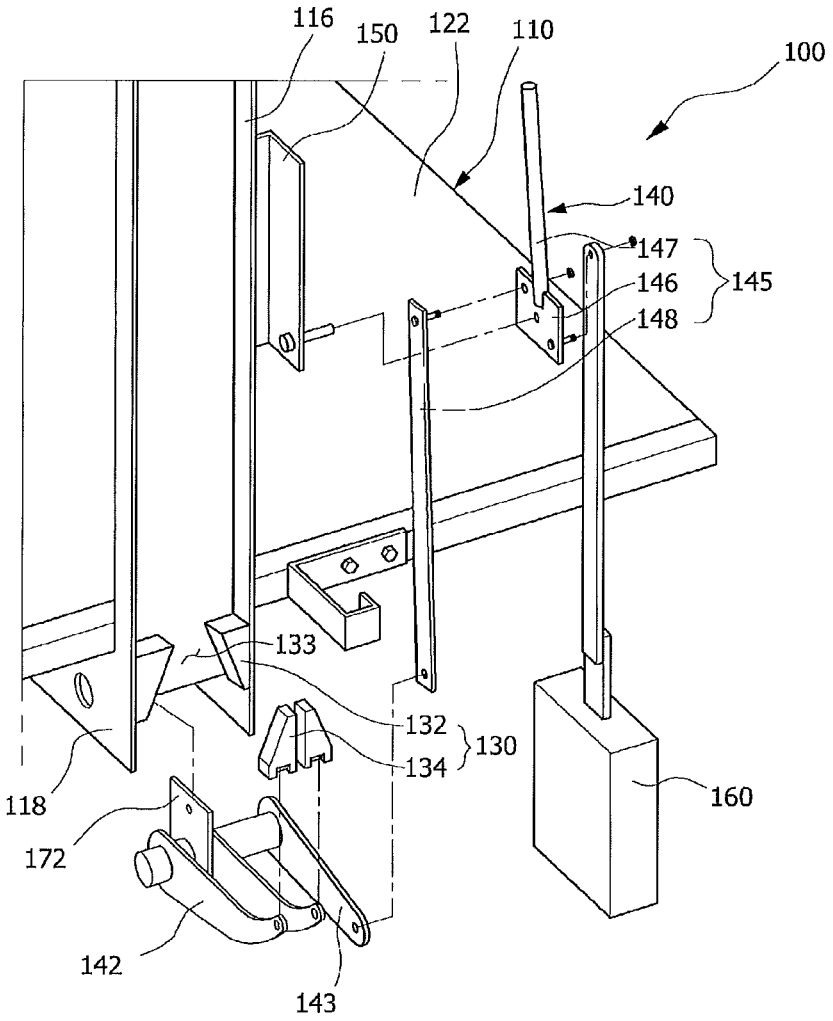
FIG. 2 is an exploded perspective view illustrating an emergency stop device with a hand brake system attached thereto according to an exemplary embodiment of the present invention.
Figure 3:
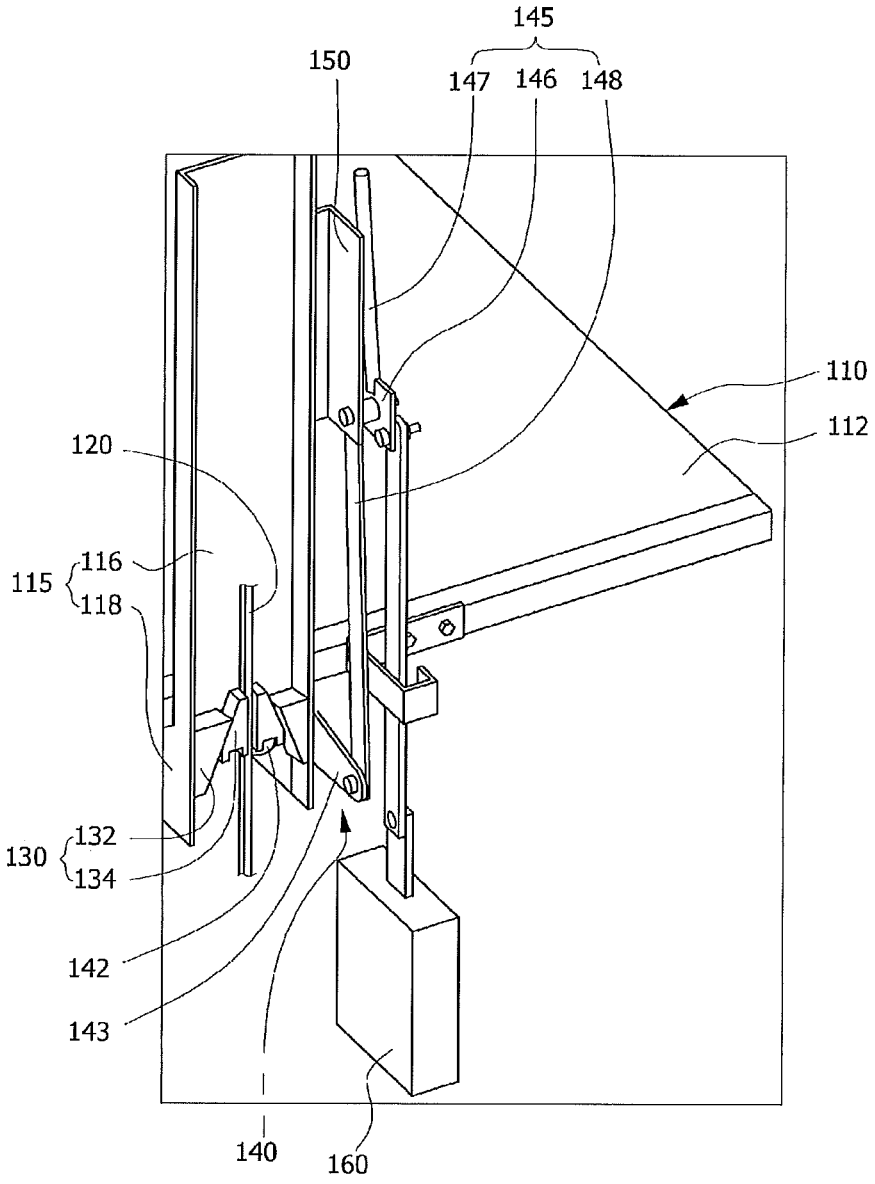
FIG. 3 is a perspective view illustrating the emergency stop device with the hand brake system according to the exemplary embodiment of the present invention in an assembled state.
Figure 4:
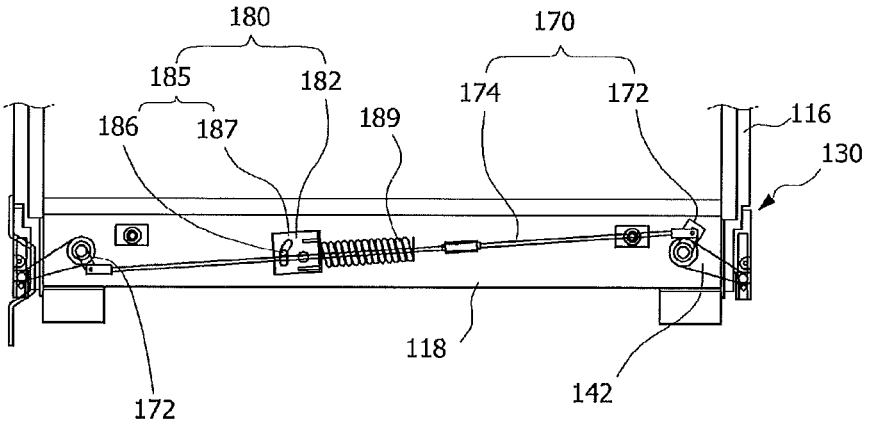
FIG. 4 is a view illustrating an operation of the emergency stop device with the hand brake system according to the exemplary embodiment of the present invention.
Figure 5:
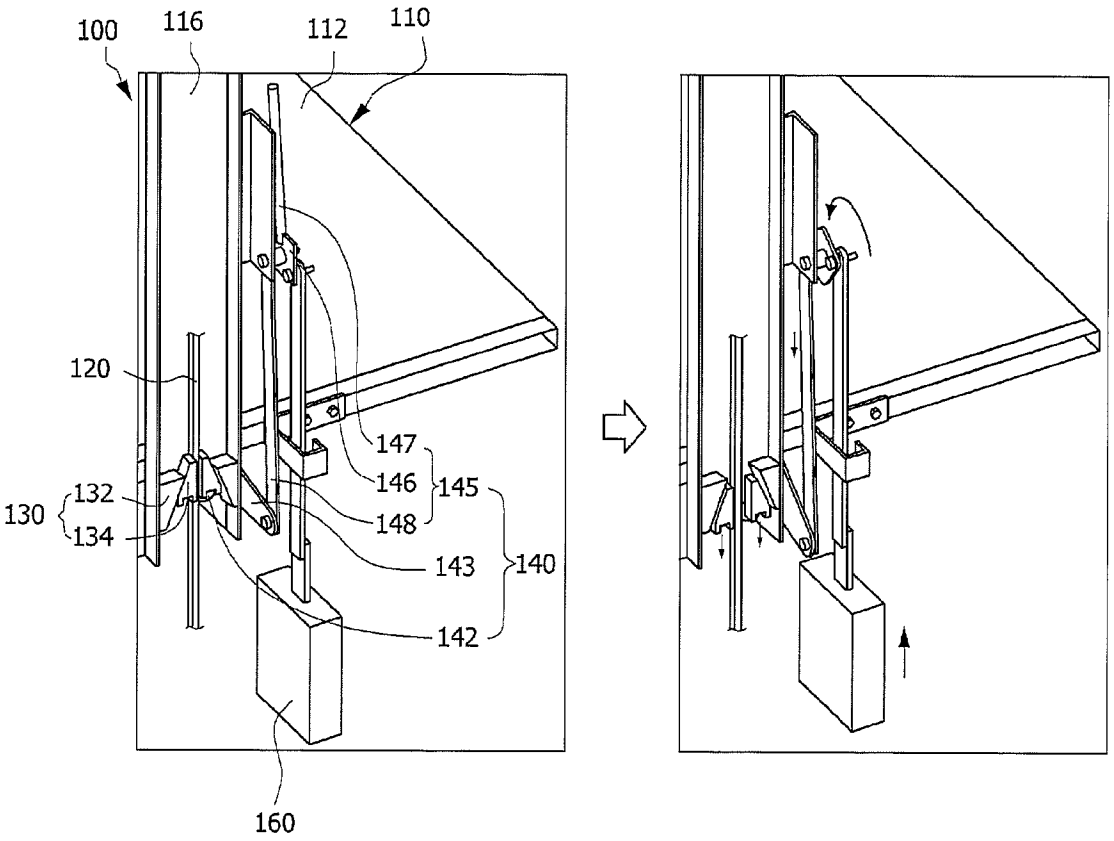
FIG. 5 is a view illustrating an interlocking unit of the emergency stop device with the hand brake system according to the exemplary embodiment of the present invention.

FIG. 2 is an exploded perspective view illustrating an emergency stop device with a hand brake system attached thereto according to an exemplary embodiment of the present invention, and FIG. 3 is a perspective view illustrating the emergency stop device with the hand brake system according to the exemplary embodiment of the present invention in an assembled state. FIG. 4 is a view illustrating an operation of the emergency stop device with the hand brake system according to the exemplary embodiment of the present invention, and FIG. 5 is a view illustrating an interlocking unit of the emergency stop device with the hand brake system according to the exemplary embodiment of the present invention. In addition, FIGS. 6 to 9 are views illustrating modified examples of an operation unit of the emergency stop device with the hand brake system according to the exemplary embodiment of the present invention.

Referring to FIGS. 2 to 5, an emergency stop device 100 with a hand brake system attached thereto according to an exemplary embodiment of the present invention includes a brake unit 130, an operation unit 140, and an interlocking unit 170.

A car 110 is provided on an elevation passage and includes a base plate 112 and a body framework 115 provided around the base plate 112. The body framework 115 includes a top frame (not illustrated), a side frame 116, and a bottom frame 118. The top frame is connected to a winch so as to move the car 110 up and down within the elevation passage.

Brake units 130 are provided on both sides of the car 110 to be selectively interfered with a guide rail 120 so as to restrain the movement of the car 110. The brake units 130 are installed on the side frames 116 provided at the both sides of the car 110. Each of the brake units 130 includes accommodation blocks 132 that form a restraint slot 133 that accommodates the guide rail 120 and is narrowed toward the upper portion, and friction blocks 134 provided between the accommodation blocks 132 and moved in the restraint slot 133 by manipulating the operation unit 140 to be interfered with the guide rail 120. That is, the guide rail 120 is accommodated in the restraint slot 133 formed by the accommodation blocks 132, and when the friction blocks 134 provided in the restraint slot 133 are moved upward, the friction blocks 134 come in contact with the guide rail 120 by the restraint slot 133 which is narrowed toward the upper portion, thereby restraining the movement of the car 110. At this time, the outer surfaces of the friction blocks 134 are formed to be inclined to correspond to the restraint slot 133.

The operation unit 140 is connected to a brake unit 130 to provide a braking force to the brake unit 130 when the operation unit 140 is manually operated. The operation unit 140 moves the friction blocks 134 between the accommodation blocks 132. The operation unit 140 includes rotation brackets 142 which are rotatably provided in the car 110, each of the rotation brackets 142 having an end connected with one of the friction blocks 134 so that, when the rotation brackets 142 are rotated, the friction blocks 134 are interfered with the guide rails 120, and a lever unit 145 that rotates the rotation brackets 142.

The rotation brackets 142 are rotatably connected to the lower frame 118 and extend outward to be hinged to the friction blocks 134 at the ends thereof, respectively.

On a side of the rotation brackets 142, an actuation piece 143 is integrally formed which eccentrically extends to be connected to the lever unit 145.

The lever unit 145 includes an operation piece 146 hinged to the car 110, an operation lever 147 provided on the operation piece 146 to rotate the operation piece 146, and a link member 148 eccentrically connected to the operation piece so as to transmit the rotation of the operation piece 146 to the rotation bracket 142.

A separate clamping bracket 150 is formed on the side frame 116 of the car 110, and the operation piece 146 is hinged to the clamping bracket 150. The link member 148 is connected to be eccentric with reference to the center of the operation piece 146, and the link member 148 is hinged to the actuation piece 143 of the rotation bracket 142.

The lever unit 145 includes a braking retaining maintaining unit 160 that is installed on the operation unit 146 to maintain the braking condition of the car 110.

The braking maintaining unit 160 includes a weight eccentrically connected to the operation piece 146. The link member 148 is connected to be eccentric to a side of the operation piece 146, and the braking maintaining unit 160 having a predetermined load is provided opposite to the link member 148 so that, when the operation lever 147 is not operated, the rotation bracket 142 is always rotated so that the friction blocks 134 and the guide rail 120 are interfered with each other. This is provided in order to maintain the stop state of the car 110 by the braking maintaining unit 160 so as to prevent a potential error from happening. Accordingly, in order to release the interference between the friction blocks 134 and the guide rail 120, it is necessary to pull the operation lever 147 using a force that may lift up the weight.

In the present exemplary embodiment, the weight is used for the braking maintaining unit 160. However, a separate locking member may be used to restrain the movement of the operation lever 147 so as to restrain the movement of the car 110, and various modifications may be made.

The braking maintaining units 130 provided at both sides of the car 110 are simultaneously operated by the interlocking unit 170 when the operation unit 140 is operated.

The interlocking unit 170 includes connection pieces 172 which are provided to be eccentric to the rotation brackets 142 and are point-symmetric to each other, and a connection bar 174 that interconnects the connection pieces 172.

Because the connection bar 174 is connected to the connection pieces 172 which are point-symmetric to each other, the connection bar 174 is formed to be inclined as illustrated in FIG. 5, and when one of the rotation brackets 142 connected to the operation lever 147 is rotated, the connection bar 174 transmits the rotation to the other rotation bracket 142 such that the other rotation bracket 142 is rotated in the reversed direction, thereby executing the braking action. At this time, the car 110 is provided with a guide unit 180 that guides the movement of the connection bar 174.

The guide unit 180 includes a guide bracket 182 through which the connection bar 174 extends and which is rotatably connected to the car 110, and a guide member 185 that guides the rotation of the guide bracket 182.

The guide member 185 includes a guide protrusion 186 formed on the car 110 to protrude, and a guide hole 187 formed in the guide bracket 182 in a circular arc shape so that the guide protrusion 186 is inserted into the guide hole 187. The guide member 185 includes a restoration member 189 that returns the connection bar 174 to its original position when a force applied to the operation lever 147 by a worker is removed, thereby smoothening the operation of the opposite rotation brackets 142. The restoration member 189 is made of a coil spring, one end of which is supported by the guide bracket 182 and the other end is supported by the connection bar 174.

Meanwhile, FIGS. 6 to 9 illustrate modified examples of the operation unit 140 of the emergency system 100 with the hand brake system according to the exemplary embodiment of the present invention.

Figure 6:
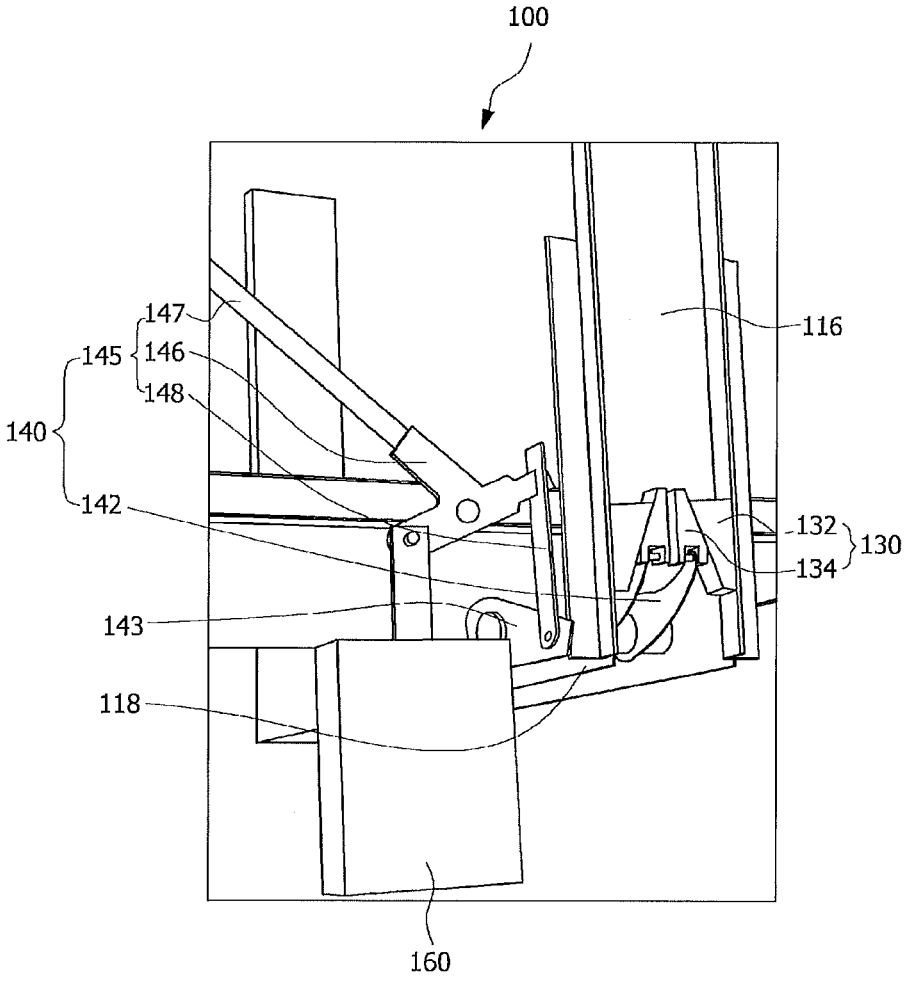
FIGS. 6 to 9 are views illustrating modified examples of an operation unit of the emergency stop device with the hand brake system according to the exemplary embodiment of the present invention.

Referring to FIG. 6, the operation piece 146 is hinged to a side of the base plate 112. The operation plate 146 is formed in a T-shape in which the central portion of the operation plate 146 is formed with the operation lever 147, one side portion of the operation plate 146 is connected with the link member 148 which is connected with the rotation bracket 142, and the other side portion is provided with the braking maintaining unit 160 configured by a weight.

Figure 7:
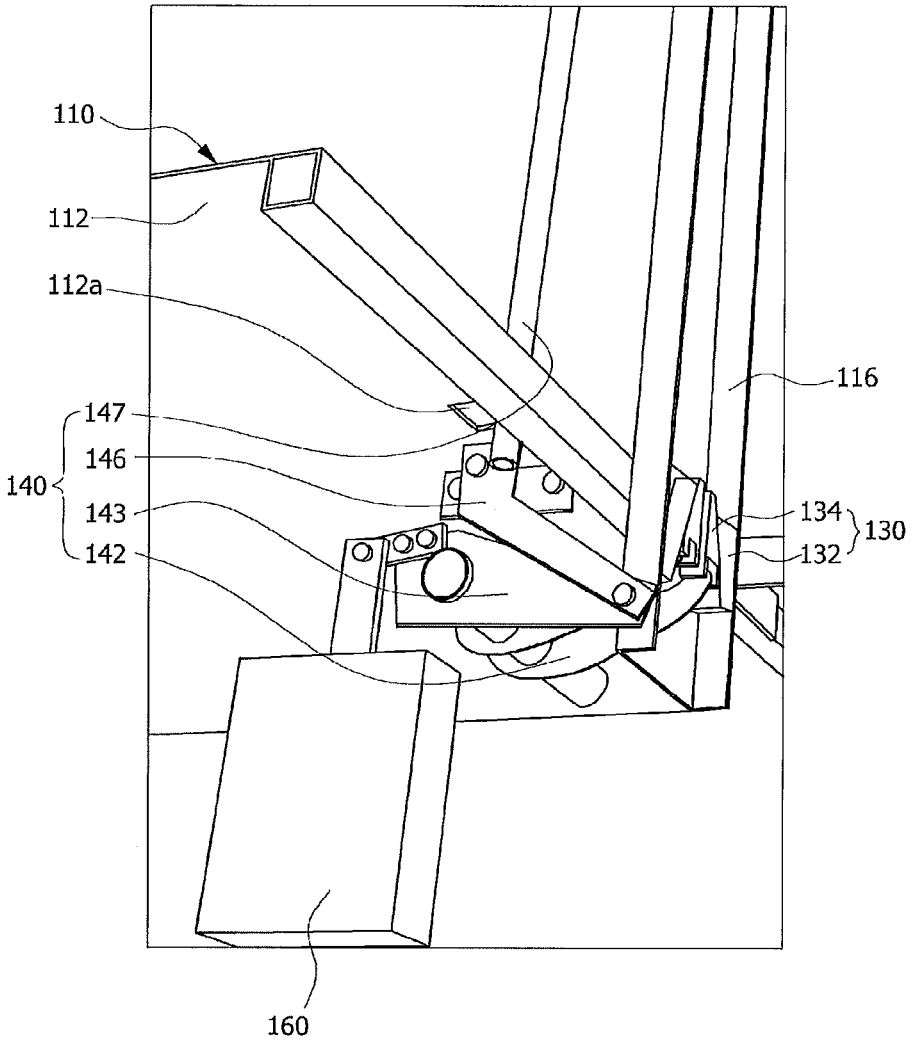

Referring to FIG. 7, an operation plate 146 is hinged to a lower portion of the base plate 112, and the braking maintaining unit 160 configured by a weight is directly and eccentrically connected to the rotation bracket 142. At this time, the base plate 112 is formed with an opening hole 112*a* so that the operation lever 147 provided on the operation piece 146 protrudes to the upper side of the base plate 112. Thus, the components except the operation lever 147 are not exposed to the outside.

Figure 8:
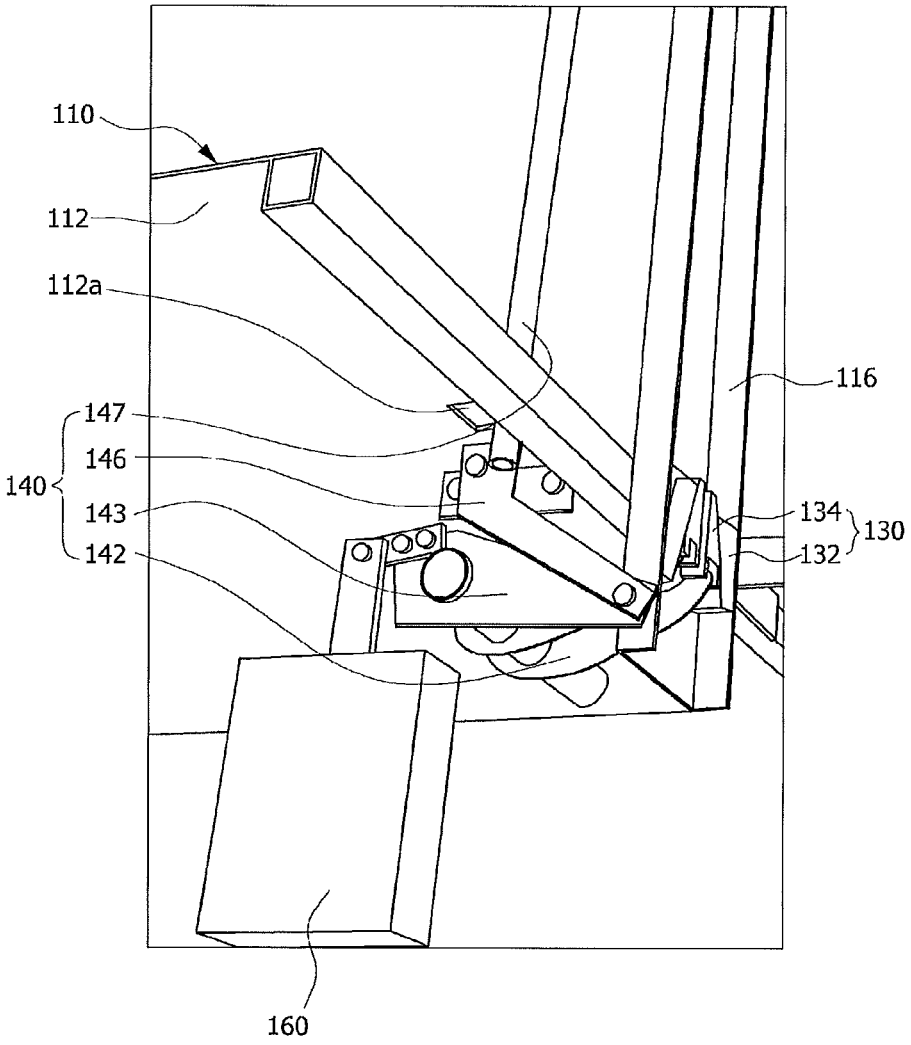

Referring to FIG. 8, the operation piece 146 of a T-shape is hinged to a side surface of the base plate 112, in which the operation lever 147 is formed at the center of the operation piece 146 and the link member 148 is connected to one side of the operation piece 146. The link member 148 is formed by a plurality of joints and the braking maintaining unit 160 configured by a weight is connected to the link member 148.

The above-described modified examples are exemplary embodiments for changing the position of the operation lever 147 and may be variously modified.

Figure 9:
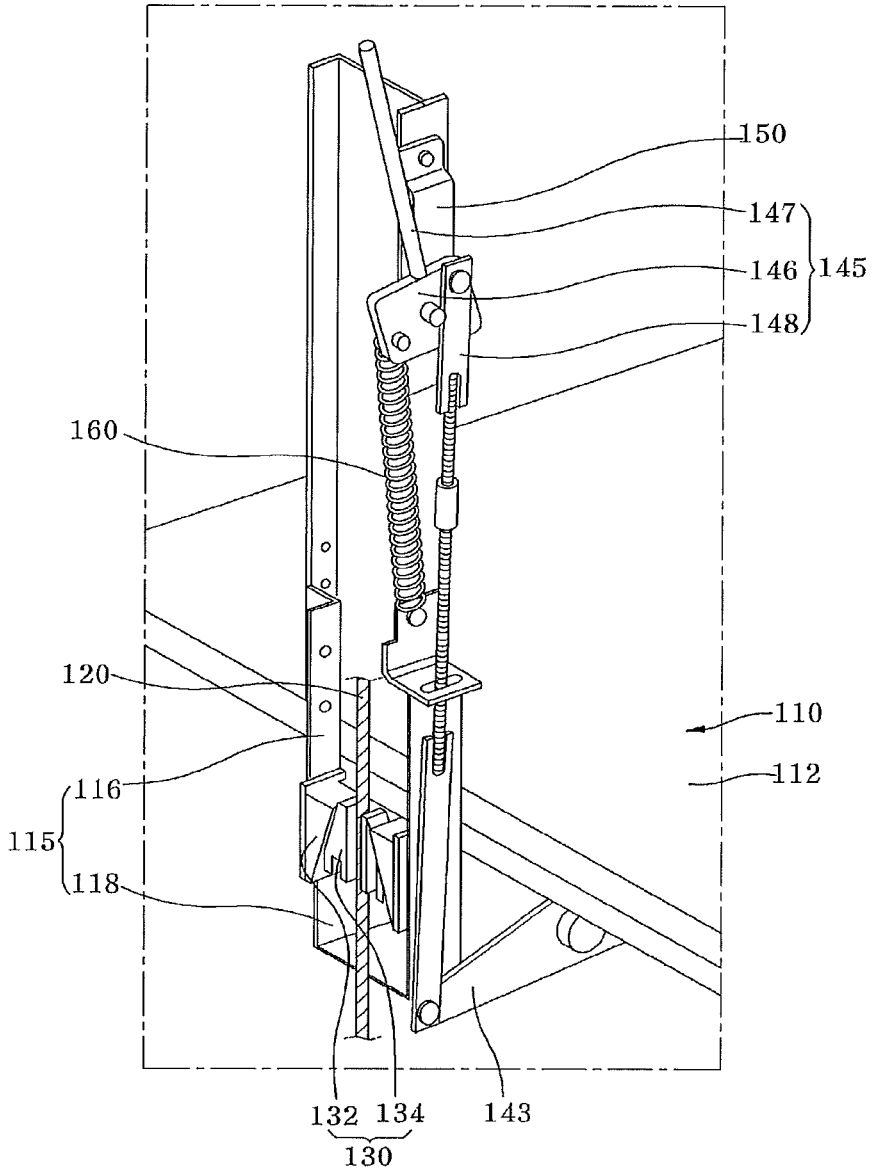

Referring to FIG. 9, as a modified example of the braking maintaining unit 160, an elastic member rather than a weight may be applied. At this time, the elastic member is made of an elastic member one side of which is eccentrically connected to the operation piece 146 and the other side is connected to the side frame 116 of the car 110. Accordingly, when the force is applied to the operation lever 147, the braking condition may be maintained by the restoring force of the elastic member. When a turn buckle is applied, the length of the link member 148 may be adjusted.

Hereinafter, the actions and effects of the emergency stop device with the hand brake system according to the exemplary embodiments of the present invention will be described.

First, when an elevator is installed, an elevation passage is formed, and the car 110 is provided in the elevation passage, and the elevator is installed while moving the car 110 up and down along the elevation passage by the winch. Accordingly, a worker may install the guide rail 120 from the bottom side to the top side in a state where the worker gets on the car 110.

Since it is impossible to provide a governor and a governor rope in the situation as described above, the emergency stop device 100 with the hand brake system attached thereto is required for the worker's safety.

Next, the operation of the emergency stop device 100 with the hand brake system attached thereto will be discussed. Initially, the operation piece 146 and the operation lever 147 are in the state where they are rotated toward the braking maintaining unit 160 by the braking maintaining unit 160 configured by a weight. Therefore, the link member 148 connected to the opposite side of the braking maintaining unit 160 is connected to the rotation brackets 142 and maintains the rotated state of the rotation brackets 142. Therefore, the friction blocks 134 are moved to the upper side and interfered with the guide rail 120, thereby restraining the movement of the car 110.

The braking maintaining unit 160 may be made of an elastic member as illustrated in FIG. 9.

The interference between the guide rail 120 and the friction blocks 134 is caused since the restraint slot 134 formed between the accommodation blocks 132 and the moving friction blocks 134 come in contact with each other such that the friction blocks 134 are sandwiched between the restraint slot 133 and the guide rail 120.

Since the car 110 is maintained in the stopped state in this manner, the worker who gets on the car 110 may perform the work for installing the elevator.

When the work at the position where the car 110 is stopped is completed, the worker pulls 147 to a side opposite to the braking maintaining unit 160 so as to release the interference between the friction blocks 134 and the guide rail 120, thereby making the car 110 movable.

The worker's pulling force should be larger than the load or elastic force of the braking maintaining unit 160. By the worker's pulling force, the link member 148 is moved downward and the rotation brackets 142 are rotated oppositely, so that the friction blocks 134 are released from the position between the restraint slot 133 and the guide rail 120 and the car becomes movable.

Thereafter, upon operating the winch to move the car 110 to a desired position and then releasing the operation lever 147, the operation lever 147 is returned to the initial state as described above by the load of the braking maintaining unit 160, thereby stopping the car 110 at the present position.

Because the movement of the car 110 can be restrained by the worker's action of releasing the operation lever 147, it is possible to quickly cope with an accident such as breaking of the winch or the like.

The braking units 130 are provided at both sides of the car 110 and simultaneously operated by the interlocking unit 170. Accordingly, the car 110 may be correctly stopped without being inclined.

The interlocking unit 170 includes the connection pieces 172 formed to be eccentric to the rotation brackets 142, respectively, and the connection bar 174 that interconnects the connection pieces 172. That is, the connection pieces 172 which are point-symmetric to each other are connected by the connection bar 174 such that the rotation of one of the rotation brackets 142 is transmitted to the other rotation bracket 142 as a reversed rotation. As a result, the braking units 130 at both sides of the car 110 may be simultaneously operated.

The connection bar 174 is correctly moved by the guide unit 180, and smoothly returned to the original position thereof by the restoration member 189 which helps the braking maintaining unit 160 to perform the braking operation correctly.

Meanwhile, as illustrated in FIGS. 6 to 9, the link member 148 may be variously modified according to the position of the operation lever 147 and hence, the position of the braking maintaining unit 160 configured by a weight may also be changed. Accordingly, the position of the operation lever 147 may be easily changed so as to improve the worker's working environment.

According to the present invention as described above, in a state where a governor cannot be connected when installing an elevator, a car may be manually stopped while installing a guide rail from the bottom side of an elevation passage toward the top side. Therefore, the working environment may be improved and a safety accident by falling may be prevented.

Because braking may be executed by a worker's simple action of releasing the operation lever, it is possible to quickly cope with an accident as soon as the accident occurs.

In addition, when the installation of the elevator is completed, the emergency stop device according to the present invention may be used as an emergency stop device by removing the lever unit and connecting the governor rope and the actuation piece.

While the invention has been described in connection with exemplary embodiments illustrated in the drawings, a person ordinarily skilled in the art will understand that the exemplary embodiments are merely illustrative and various modified and equivalent embodiments may be made therefrom.

Accordingly, the true technical scope of the present invention to be protected shall be determined by the claims.

The invention claimed is:

1. An emergency stop device with a hand brake system, comprising:

brake units which are provided on both sides of a car and selectively interfered with guide rails so as to restrain the movement of the car, the brake units comprising:

accommodation blocks that form restraint slots configured to accommodate the guide rails, respectively, each of the slots being narrowed toward an upper side; and friction blocks that are provided in the accommodation blocks, the friction blocks being configured to be moved in the restraint slots by operating the operation unit to be interfered with the guide rails;

an operation unit connected with the brake units to manually provide a braking force to the braking units, the operation unit comprising:

rotation brackets which are rotatably provided in the car, one end of each of the rotation brackets being connected with one of the friction blocks so that, when the rotation brackets are rotated, the friction blocks are interfered with the guide rails; and a lever unit configured to rotate the rotation brackets, the lever unit comprising an operation piece hinged to the car, an operation lever provided on the operation piece to rotate the operation piece, a link member eccentrically connected to the operation piece to transmit the rotation of the operation piece to the rotation brackets and a braking maintaining unit provided on the operation piece to maintain a braking state of the car; and an interlocking unit which causes the brake unit provided on both sides of the car to be interlocked by operation of the operation unit, the interlocking unit comprising connection pieces which are eccentrically provided on the rotation brackets, respectively, and point-symmetrical to each other and a connection bar that interconnects the connection pieces.

2. The emergency stop device as claimed in claim 1, wherein the braking maintaining unit comprises:

a weight eccentrically connected to the operation piece.

3. The emergency stop device as claimed in claim 1, wherein the braking maintaining unit comprises:

an elastic member one side of which is eccentrically connected to the operation piece and the other side is connected to the car.

* * * * *